US007638702B2

(12) United States Patent
Fujan

(10) Patent No.: US 7,638,702 B2
(45) Date of Patent: Dec. 29, 2009

(54) PIANO TUNING WRENCH

(76) Inventor: Steven J. Fujan, 8140 S. Pittsburg Ave., Tulsa, OK (US) 74137

( * ) Notice: Subject to any disclaimer, the term of this patent is extended or adjusted under 35 U.S.C. 154(b) by 53 days.

(21) Appl. No.: 11/004,215

(22) Filed: Dec. 3, 2004

(65) Prior Publication Data

US 2006/0117934 A1 Jun. 8, 2006

(51) Int. Cl.
*G10G 7/00* (2006.01)

(52) U.S. Cl. ..... 84/459; 81/22

(58) Field of Classification Search ..... 84/459, 84/458; 81/22, 177.1; D17/9, 20
See application file for complete search history.

(56) References Cited

U.S. PATENT DOCUMENTS

| | | | | |
|---|---|---|---|---|
| 11,852 | A | 10/1854 | Bassford | |
| 83,734 | A | 11/1868 | Sherwood | |
| 310,673 | A | 1/1885 | Hale | |
| 528,154 | A | 10/1894 | Fuchs | |
| 610,973 | A | 9/1898 | Powell | |
| 641,473 | A | 1/1900 | Sihler | |
| 775,383 | A | 11/1904 | Porter | |
| 834,468 | A | 10/1906 | Hale | |
| 1,160,107 | A * | 11/1915 | Hale | 84/459 |
| 1,512,699 | A | 10/1924 | Korach | |
| 1,693,292 | A | 11/1928 | Frauenberger | |
| 2,172,355 | A | 9/1939 | Brady | |
| 2,751,805 | A | 6/1956 | Leftly | |
| 2,802,388 | A * | 8/1957 | Luckenbach | 84/459 |
| 5,490,437 | A * | 2/1996 | Hebert et al. | 81/22 |
| 6,101,903 | A * | 8/2000 | Negley et al. | 81/64 |
| 6,202,518 | B1 * | 3/2001 | Moffitt et al. | 81/427.5 |
| 2004/0020330 | A1 * | 2/2004 | Hu | 81/177.1 |
| 2004/0177733 | A1 * | 9/2004 | Peters | 81/490 |

* cited by examiner

*Primary Examiner*—Jianchun Qin
(74) *Attorney, Agent, or Firm*—Head, Johnson & Kachigan PC

(57) ABSTRACT

An improved piano tuning hammer for use by piano technicians, that allows dramatically increased tuning accuracy, ease of use, and speed. The improved tuning hammer is comprised of relatively large cross-sections. The improved tuning hammer may be comprised of lightweight materials. The relatively large cross-sections provide increased stiffness, which serves to increase the effectiveness of the tuning process.

5 Claims, 5 Drawing Sheets

PIANO TUNING WRENCH

CROSS-REFERENCE TO RELATED APPLICATIONS

None applicable.

BACKGROUND OF THE INVENTION

The present invention relates to musical instrument tuning devices, specifically to piano tuning wrenches (also known as piano tuning hammers).

Piano tuning hammers generally consist of a lever with a wrench head on one end. The lever generally consists of a solid steel shank with a handle at the end opposite the wrench head. A typical known prior art tuning wrench is shown in FIG. 1. The wrench head of a tuning wrench includes a socket of the usual form and shape, for engagement with the tuning pins of a piano. The piano technician tunes the piano string by moving the handle of the tuning wrench while the socket is engaged upon the tuning pin as shown in FIG. 2A. This action rotates the tuning pin causing the string to wind or unwind around the tuning pin, thereby changing the string tension. The actual movement of the tuning wrench required to bring the string to proper pitch is extremely small. Accordingly, much practice and skill is required to accurately and efficiently tune an entire piano.

When the piano technician applies a force to the handle of a tuning wrench, the tuning wrench flexes as shown in FIG. 2B. When the tuning wrench deflects, it acts like a spring storing energy. Initially the tuning pin is restrained from rotation by static friction between the pin and its corresponding hole in the pin block. As the force on the tuning wrench increases, eventually the static friction is overcome and the pin begins to rotate. But when the pin begins to rotate the friction between the pin and pin block becomes sliding friction, which is less than static friction. The "wind up" that is present in deflection of the tuning wrench instantly releases and rotates the pin more than the technician intended. This results in "overshoot" and difficulty for the piano tuner to achieve accurate results.

Another known prior art tuning wrench is shown in FIG. 3. This tuning wrench has a solid steel hexagonal shank with an extendable handle. It is commonly called the "Hale extension hammer" and is widely thought to be the finest currently available, although it was developed before 1915. When adjusted to its shortest length, this type of tuning wrench may be slightly stiffer than the simple shank type of FIG. 1 due to the wood handle, but only marginally so. In addition, the telescoping feature is prone to developing movement in the sliding and gripping mechanism, thereby increasing the deflection and reducing the precision.

There have been many attempts to overcome the deficiencies of the prior art tuning hammers shown in FIG. 1 and FIG. 3. U.S. Pat. No. 610,973 to Powell (1898), U.S. Pat. No. 1,512,699 to Korach (1924), U.S. Pat. No. 2,172,355 to Brady (1939), and U.S. Pat. No. 2,751,805 to Leftly (1956) all attempt to increase the accuracy of the tuning process. A disadvantage of all four of these devices is that they all rely on an adjacent tuning pin to act as an anchor to react the torque multiplication of their gear mechanisms. This causes the anchor pin to go out of tune, which is not desirable.

Accordingly, an object of the present invention is to provide a piano tuning wrench that provides dramatically increased tuning accuracy, ease of use, and speed. This is accomplished by dramatically increased stiffness compared to the prior art. By dramatically increasing the stiffness of the wrench, the deflection is dramatically reduced and the resulting rotation of the tuning pin is more predictable.

Increased stiffness also allows the length of the wrench to be increased, allowing more increase in accuracy because the longer wrench will provide less rotation of the tuning pin for a given translation of the gripped end, resulting in greater sensitivity and tuning accuracy. The longer wrench also requires less force at the grip for a given level of torque at the tuning pin, further increasing sensitivity, accuracy, and reducing technician fatigue. Another benefit of the longer wrench and the reduced force requirement is reduced prying effect of the tuning pin. Since the handle of a tuning wrench is not in the same plane as the pin block, there will be a prying effect at the tuning pin, and consequently at the pin block. Reduction of this extra prying effect also serves to increase the predictability of the tuning process.

Very little advancement in piano tuning wrench design has been made in the past century. The best tuning hammers previously available, such as those of FIG. 1 and FIG. 3, incorporate features from patents granted in the early part of the 20th century. Considering that there is no evidence of successful advancements since that time, the elegant simplicity of the present invention is not obvious, and is novel in character.

BRIEF SUMMARY OF THE INVENTION

A piano tuning wrench that allows dramatically increased tuning accuracy, ease of use, and speed. This is accomplished by dramatically increased stiffness compared to the prior art. In the preferred embodiment this is accomplished by the use of lightweight materials and large cross sections. The increased stiffness serves to increase the effectiveness of the tuning process.

Figure 1:
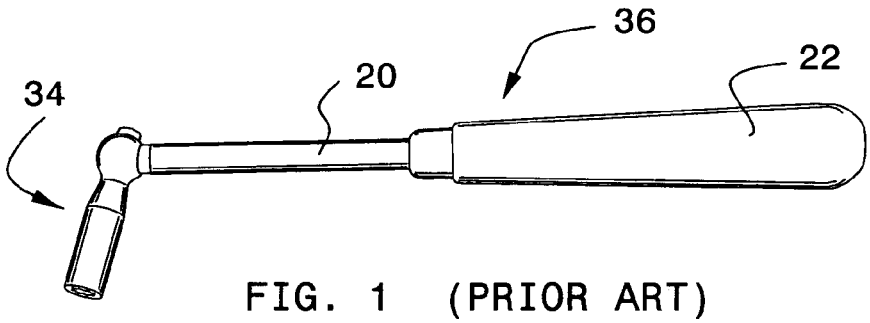
FIG. 1 (PRIOR ART)
FIG. 1 shows a typical known prior art tuning wrench.
Figure 2A:
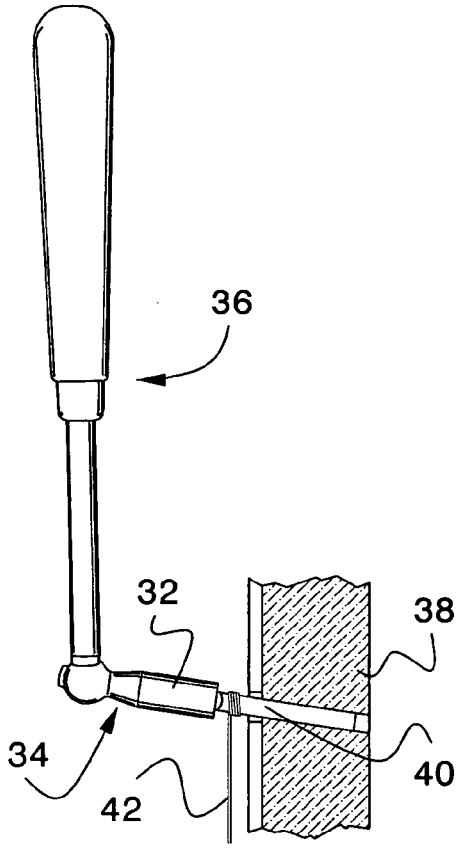
FIG. 2A (PRIOR ART)
FIG. 2A shows a typical known prior art tuning wrench and a cross section of a typical pin block of a piano.
Figure 2B:
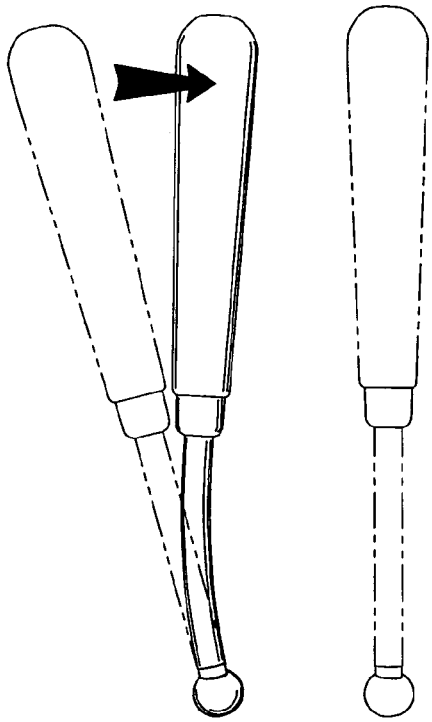
FIG. 2B (PRIOR ART)
FIG. 2B shows an exaggerated typical deflection character of a prior art tuning wrench.

| REFERENCE NUMERALS USED IN THE DRAWINGS | |
|---|---|
| 20 | shank |
| 22 | handle |
| 24 | wrench head housing |
| 26 | hole |
| 28 | spindle |
| 30 | spindle shaft |
| 32 | socket tip |
| 34 | wrench head |
| 36 | lever |
| 38 | pin block |
| 40 | tuning pin |
| 42 | piano string |

DETAILED DESCRIPTION OF THE INVENTION

The following descriptions of the disclosed embodiments are not intended to limit the scope of the invention to the precise form or forms detailed herein. Instead, the following description is intended to be illustrative of the principles of the invention so that others may follow its teachings.

Figure 4:
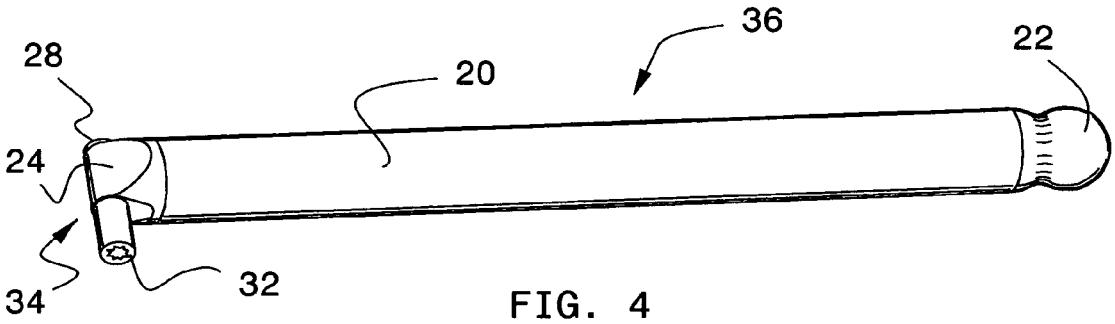
FIG. 4 shows an improved tuning wrench, in accordance with the invention.
Figure 5:
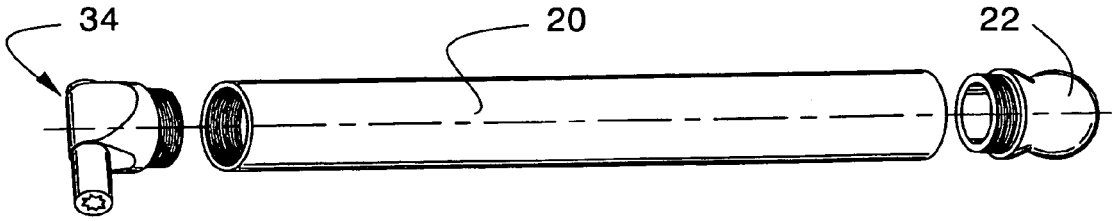
FIG. 5 shows an exploded view of the improved tuning wrench of FIG. 4.

Referring now to FIG. 4 and FIG. 5 of the drawings, a piano tuning wrench in accordance with the teachings of the first disclosed embodiment of the present invention is shown. The piano tuning wrench includes a lever 36 that is comprised of a shank 20 and a handle 22. The shank 20 is comprised of a hollow aluminum tube with a first end and a second end, both ends internally threaded. In this embodiment, the shank 20 is approximately 1.50 inch outside diameter with 0.125 inch wall thickness. However, the shank 20 could be any other hollow section shape, such as square, rectangular, hexagonal, etc. Since the shank 20 may be gripped by the hand in some tuning and positioning situations, knurling or some other texture could be added to increase security of the gripping action.

A handle 22 is comprised of aluminum and has external threads for attachment to the shank 20 at the first end. The handle 22 could optionally be comprised of a threaded aluminum stem with a wooden handgrip. The handle 22 could be made of many materials and shaped in many ways depending on the piano technician's preference.

Figure 10A:
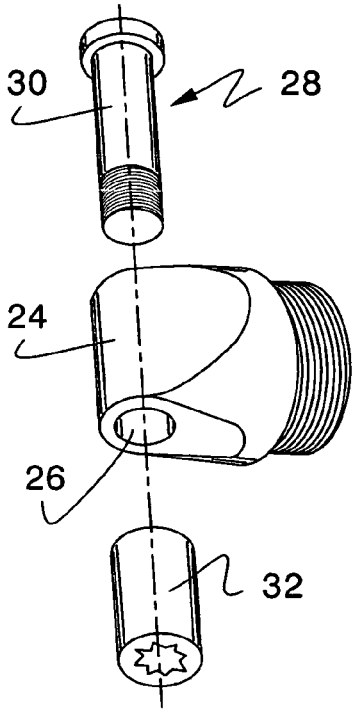
FIGS. 10A, 10B and 10C illustrate a sequence of drawings with FIG. 10A showing the wrench head 34 exploded, FIG. 10B showing the spindle 28 in the hole in the housing 24, and FIG. C showing the wrench head assembled.
Figure 10B:
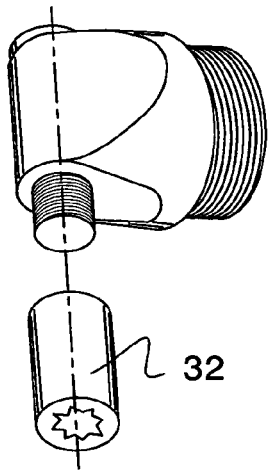
Figure 10C:
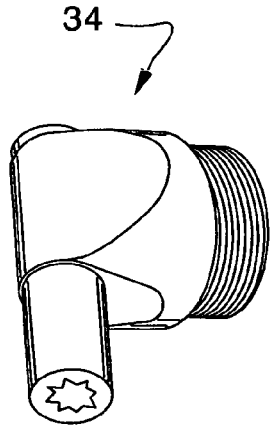

Referring now also to FIG. 10, a wrench head housing 24 is comprised of aluminum and has external threads for attachment to the shank 20 at the second end. The wrench head housing 24 also has a hole 26 situated to be nearly perpendicular to the axis of the shank 20. A spindle 28 is installed into the hole 26, and preferably there is a tight fit between the spindle shaft 30 and the hole 26. The tight fit provides minimum flex between these parts while in use. A socket tip 32 of the usual type is screwed onto the exposed threaded portion of the spindle 28. The wrench head housing 24 is unique due to its large cross-sections and direct connection to the socket tip 32.

Figure 3:
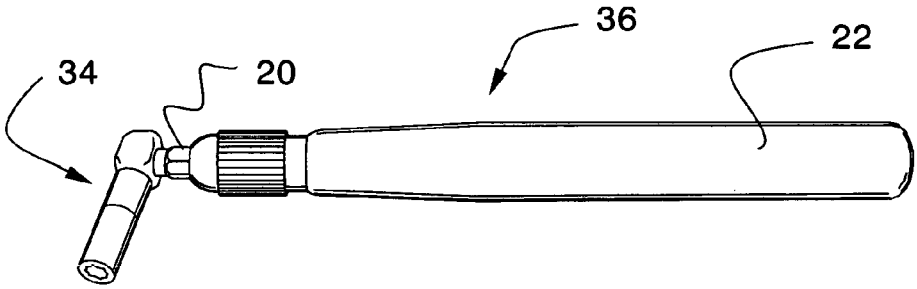
FIG. 3 (PRIOR ART)
FIG. 3 shows a typical extendable prior art tuning wrench.

The complete assembly shown in FIG. 4 comprises a tuning wrench of similar basic operational principle as the prior art examples in FIG. 1 and FIG. 3, but with all the advantages of the present invention.

This preferred embodiment is a modular tuning wrench system whereby the wrench head 34, the shank 20, and the handle 22 can be interchanged to suit a particular technique or situation. For example, several wrench heads with different spindle angles could be provided. Several lengths of shank 20 could be provided, multiple shank segments could be coupled together, and even different handles could be used for different tuning situations.

The preferred material choice is aluminum, but many other materials could be used such as magnesium, which is even lighter than aluminum.

A typical prior art tuning wrench of FIG. 1 has a solid steel shank of about 0.437 inch diameter. The bending stiffness of this shank as compared to the preferred embodiment described above can be quantified by classical mechanical relations.

The lever of the tuning wrench is a cantilever beam. The deflection of a cantilever beam is described by the following equation:

$$\delta = \frac{Fl^3}{3EI} \qquad \text{Eqn. 1}$$

Where: δ is the deflection, F is the applied force, l is the length of the cantilever beam, E is the elastic modulus of the material, and I is the cross-section moment of inertia. The cross-section moment of inertia is dependent on the shape of the cross-section. For a round bar and a cylindrical tube, the cross-section moment of inertia are respectively defined by:

$$I = \frac{\pi d_o^4}{64}, \quad I = \frac{\pi(d_o - d_i)^4}{64} \qquad \text{Eqn. 2a, 2b}$$

Where: $d_o$ is the outside diameter, and $d_i$ is the inside diameter.

Assuming that the applied force, and length of the cantilever beam are held constant for both the prior art and the present invention, the ratio of deflection can be calculated as follows:

$$\frac{\delta_{Prior}}{\delta_{New}} = \frac{\left(\frac{Fl^3}{3E_{Prior}I_{Prior}}\right)}{\left(\frac{Fl^3}{3E_{New}I_{New}}\right)} = \frac{E_{New}I_{New}}{E_{Prior}I_{Prior}} \qquad \text{Eqn. 3}$$

The referenced dimensions for the preferred embodiment and the prior art tuning hammers yield cross-section moments of inertia of 0.129 $in^4$ and 0.00179 $in^4$ respectively. The elastic modulus of aluminum and steel are respectively $10\times10^6$ psi, and $29\times10^6$ psi. Substituting these values into Eqn. 3 gives a deflection ratio of:

$$\frac{\delta_{Prior}}{\delta_{New}} = \frac{E_{New}I_{New}}{E_{Prior}I_{Prior}} = \frac{(10\times10^6)(0.129)}{(29\times10^6)(0.00179)} = 24.85$$

This exercise shows that the referenced preferred embodiment is nearly 25 times stiffer than the prior art tuning wrench. And since the preferred embodiment is comprised of tubular aluminum, its weight is comparable to the prior art tuning wrench.

The dramatically increased stiffness reduces the energy stored by flexing of the piano tuning wrench. Therefore, the "overshoot" due to the transistion from static to dynamic friction conditions (as the tuning pin begins to rotate) is dramatically reduced, and the resulting rotation of the tuning pin is more predictable.

Figure 6A:
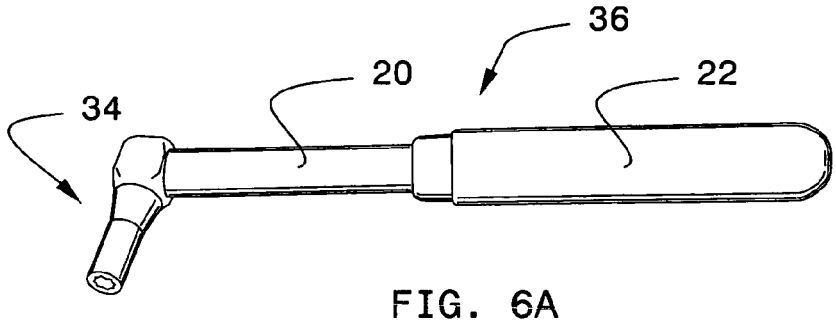
FIG. 6A and FIG. 6B shows an improved tuning wrench with large section shank made of lightweight material. A normal handle length version is shown in FIG. 6A, as well as a long handle version in FIG. 6B.
Figure 6B:
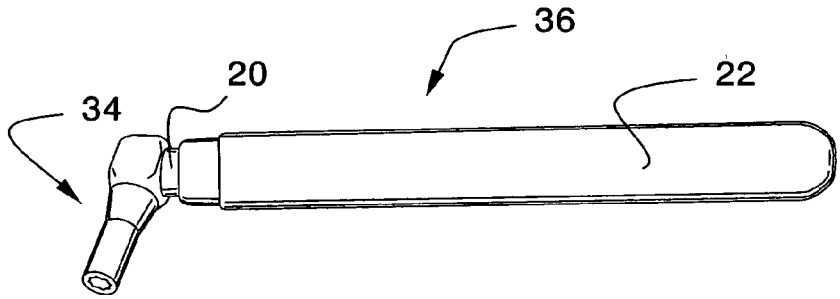

Another embodiment of the present invention has a shank 20 made of lightweight material such as aluminum. Two specific examples of this embodiment are shown in FIG. 6, each having a shank 20 comprised of a solid round bar made of aluminum with approximately 0.75" diameter. Because this simple shank 20 is made of lightweight material, it has a larger cross-section for a given weight. Compared to the prior art tuning hammer of FIG. 1, this embodiment is approximately three times stiffer, while the weight is comparable. Both long and short handled versions of this embodiment are shown in FIG. 6.

Figure 7:
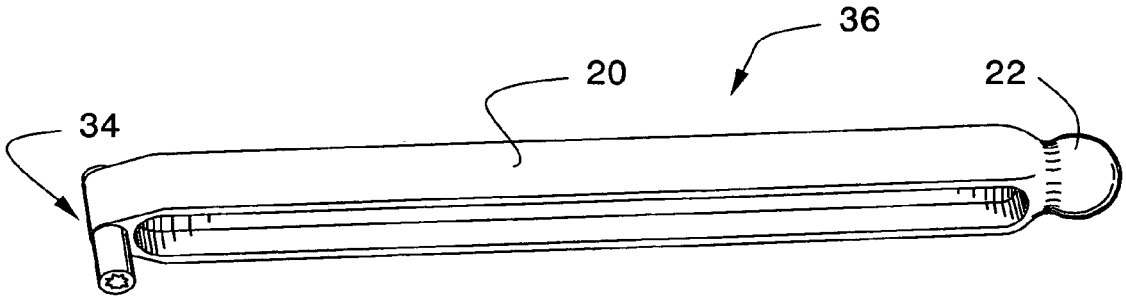
FIG. 7 shows an improved tuning wrench with complex shaped lever, in this case the shank being the shape of an "I-beam".

Another embodiment of the present invention has a lever 36 with a complex shaped cross-section such as the I-beam cross-section as shown in FIG. 7. The basic I-beam cross-section is known to be very stiff considering its weight. This embodiment could be particularly effective if the lever 36 were manufactured by a casting or forging process.

Figure 8:
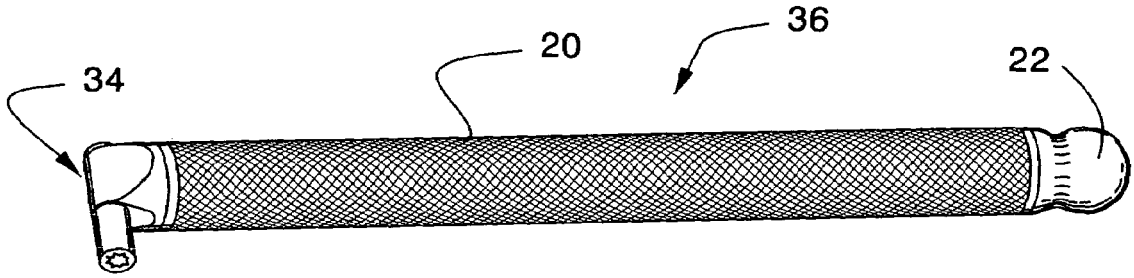
FIG. 8 shows an improved tuning wrench with composite shank, in this case the composition being carbon fiber over a foam core.

FIG. 8 shows an improved tuning wrench with composite shank 20, in this case the composition is carbon fiber tube, or carbon fiber over a foam core. This embodiment has the potential for extremely high stiffness due to the multitude of composite shapes possible, although the current state of the art in composite manufacturing is somewhat expensive.

Figure 9:
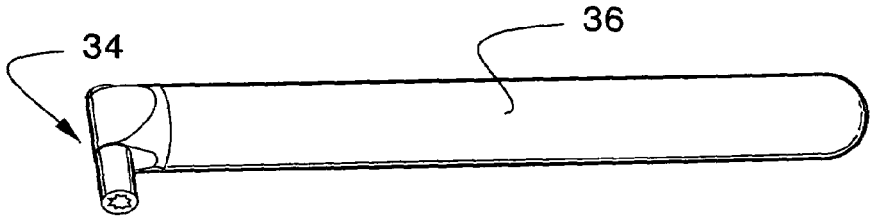
FIG. 9 shows an improved tuning wrench, wherein the handle is simply part of the lever and cannot be categorized separately.

FIG. 9 shows an improved tuning wrench, wherein the handle 22 and the shank 20 are simply part of the lever 36 and cannot be categorized separately. This embodiment could result in a less expensive tuning wrench, although the modularity of the interchangeable handle is sacrificed.

FIG. 10 shows a wrench head 34 that is comprised of multiple pieces. A preferred embodiment wrench head 34 is comprised of the wrench head housing 24 and a spindle 28 securely fit into a hole 26 in said housing 24. The preferred wrench head housing 24 is made of aluminum, and the preferred spindle 28 is made of high-strength steel.

Those skilled in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the appended claims either literally or under the doctrine of equivalents.

What is claimed is:

1. A piano tuning wrench comprising:

a socket tip for engagement with a tuning pin of a piano;

a tubular lever threadedly and removably connected to said socket tip at a first end of said lever;

a handle threadedly connected to a second end of said lever; and means for achieving bending stiffness of said lever substantially greater than a solid round steel bar of approximately 0.437 inch diameter, providing increased tuning precision as a result of the bending stiffness means.

2. A piano tuning wrench as set forth in claim 1 wherein said tubular lever is a composite of a carbon fiber.

3. A piano tuning wrench comprising:

a socket tip for engagement with a. tuning pin of a piano;

a lever removably connected to said socket tip at a first end of said lever, wherein said lever has an I-beam cross section;

a handle connected to a second end of said lever; and means for achieving bending stiffness of said lever substantially greater than a solid round steel bar of approximately 0.437 inch diameter, providing increased tuning precision as a result of the bending stiffness means.

4. A piano tuning wrench comprising:

a socket tip for engagement with a tuning pin of a piano, wherein said socket tip has a diameter;

a lever removably connected to said socket tip at a first end of said lever;

a handle connected to a second end of said lever; and means for achieving bending stiffness of said lever substantially greater than a solid round steel bar of approximately the same diameter as said socket tip, providing increased tuning precision as, a result of the bending stiffness means.

5. A piano tuning wrench as set forth in claim 4 wherein said lever is tubular.

* * * * *